US008322143B2

(12) United States Patent
Uhm et al.

(10) Patent No.: US 8,322,143 B2
(45) Date of Patent: Dec. 4, 2012

(54) SYSTEM AND METHOD FOR INJECTING FUEL

(75) Inventors: Jong Ho Uhm, Simpsonville, SC (US); Thomas Edward Johnson, Greer, SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 13/008,890

(22) Filed: Jan. 18, 2011

(65) Prior Publication Data

US 2012/0180495 A1 Jul. 19, 2012

(51) Int. Cl.
*F02C 1/00* (2006.01)

(52) U.S. Cl. ..... 60/737

(58) Field of Classification Search ..... 60/733, 60/737–738, 740, 742, 746–748; 239/427, 239/533.2, 548, 553.3, 557, 590.3
See application file for complete search history.

(56) References Cited

U.S. PATENT DOCUMENTS 4,107,918 A * 8/1978 Andrew et al. ..... 60/737
5,339,635 A * 8/1994 Iwai et al. ..... 60/733
5,713,206 A * 2/1998 McWhirter et al. ..... 60/747
6,038,861 A * 3/2000 Amos et al. ..... 60/737
2003/0167771 A1* 9/2003 Hayashi et al. ..... 60/737
2009/0077972 A1 3/2009 Singh
2009/0223227 A1* 9/2009 Lipinski et al. ..... 60/746
2010/0186413 A1* 7/2010 Lacy et al. ..... 60/740
2010/0218501 A1 9/2010 York et al.
2011/0067404 A1* 3/2011 Johnson et al. ..... 60/747
2011/0289928 A1* 12/2011 Fox et al. ..... 60/740

OTHER PUBLICATIONS

U.S. Appl. No. 13/009,299, filed Jan. 19, 2011, Uhm et al.
U.S. Appl. No. 12/832,330, filed Jul. 8, 2010, Uhm et al.
U.S. Appl. No. 12/833,237, filed Jul. 9, 2010, Kwanwoo Kim.

* cited by examiner

*Primary Examiner* — Phutthiwat Wongwian
(74) *Attorney, Agent, or Firm* — Fletcher Yoder P.C.

(57) ABSTRACT

According to various embodiments, a system includes a staggered multi-nozzle assembly. The staggered multi-nozzle assembly includes a first fuel nozzle having a first axis and a first flow path extending to a first downstream end portion, wherein the first fuel nozzle has a first non-circular perimeter at the first downstream end portion. The staggered multi-nozzle assembly also includes a second fuel nozzle having a second axis and a second flow path extending to a second downstream end portion, wherein the first and second downstream end portions are axially offset from one another relative to the first and second axes. The staggered multi-nozzle assembly further includes a cap member disposed circumferentially about at least the first and second fuel nozzles to assemble the staggered multi-nozzle assembly.

23 Claims, 4 Drawing Sheets

SYSTEM AND METHOD FOR INJECTING FUEL

STATEMENT REGARDING FEDERALLY SPONSORED RESEARCH & DEVELOPMENT

This invention was made with Government support under contract number DE-FC26-05NT42643 awarded by the Department of Energy. The Government has certain rights in the invention.

BACKGROUND OF THE INVENTION

The subject matter disclosed herein relates to a gas turbine engine and, more specifically, to a fuel nozzle assembly with features to reduce amplitudes in combustion dynamics and to improve durability, operability, and reliability.

A gas turbine engine combusts a mixture of fuel and air to generate hot combustion gases, which in turn drive one or more turbines. In particular, the hot combustion gases force turbine blades to rotate, thereby driving a shaft to rotate one or more loads, e.g., an electrical generator. The gas turbine engine includes a fuel nozzle assembly, e.g., with multiple fuel nozzles, to inject fuel and air into a combustor. In certain combustors, combustion processes may generate large amplitude pressure oscillations (e.g., screech) driven by oscillations in heat release due to coupling between flames of adjacent fuel nozzles and acoustic waves. These large pressure oscillations may impose operational limits and eventually result in combustor hardware damage.

BRIEF DESCRIPTION OF THE INVENTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In accordance with a first embodiment, a system includes a staggered multi-nozzle assembly. The staggered multi-nozzle assembly includes a first fuel nozzle having a first axis and a first flow path extending to a first downstream end portion, wherein the first fuel nozzle has a first non-circular perimeter at the first downstream end portion. The staggered multi-nozzle assembly also includes a second fuel nozzle having a second axis and a second flow path extending to a second downstream end portion, wherein the first and second downstream end portions are axially offset from one another relative to the first and second axes. The staggered multi-nozzle assembly further includes a cap member disposed circumferentially about at least the first and second fuel nozzles to assemble the staggered multi-nozzle assembly.

In accordance with a second embodiment, a system includes a turbine nozzle assembly. The turbine nozzle assembly includes a first fuel nozzle including a first axis and first multiple premixing tubes extending to a first downstream end portion, wherein the first fuel nozzle has a first truncated pie-shaped perimeter at the first downstream end portion. The turbine nozzle assembly also includes a second fuel nozzle having a second axis and second multiple premixing tubes extending to a second downstream end portion, wherein the first and second downstream end portions are axially offset from one another relative to the first and second axes.

In accordance with a third embodiment, a method includes routing fuel and air through a first fuel nozzle to a first downstream end portion, wherein the first fuel nozzle has a first non-circular perimeter at the first downstream end portion. The method also includes routing fuel and air through a second fuel nozzle to a second downstream end portion, wherein the first and second downstream end portions are staggered to reduce an amplitude of combustion dynamics

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

Figure 1:
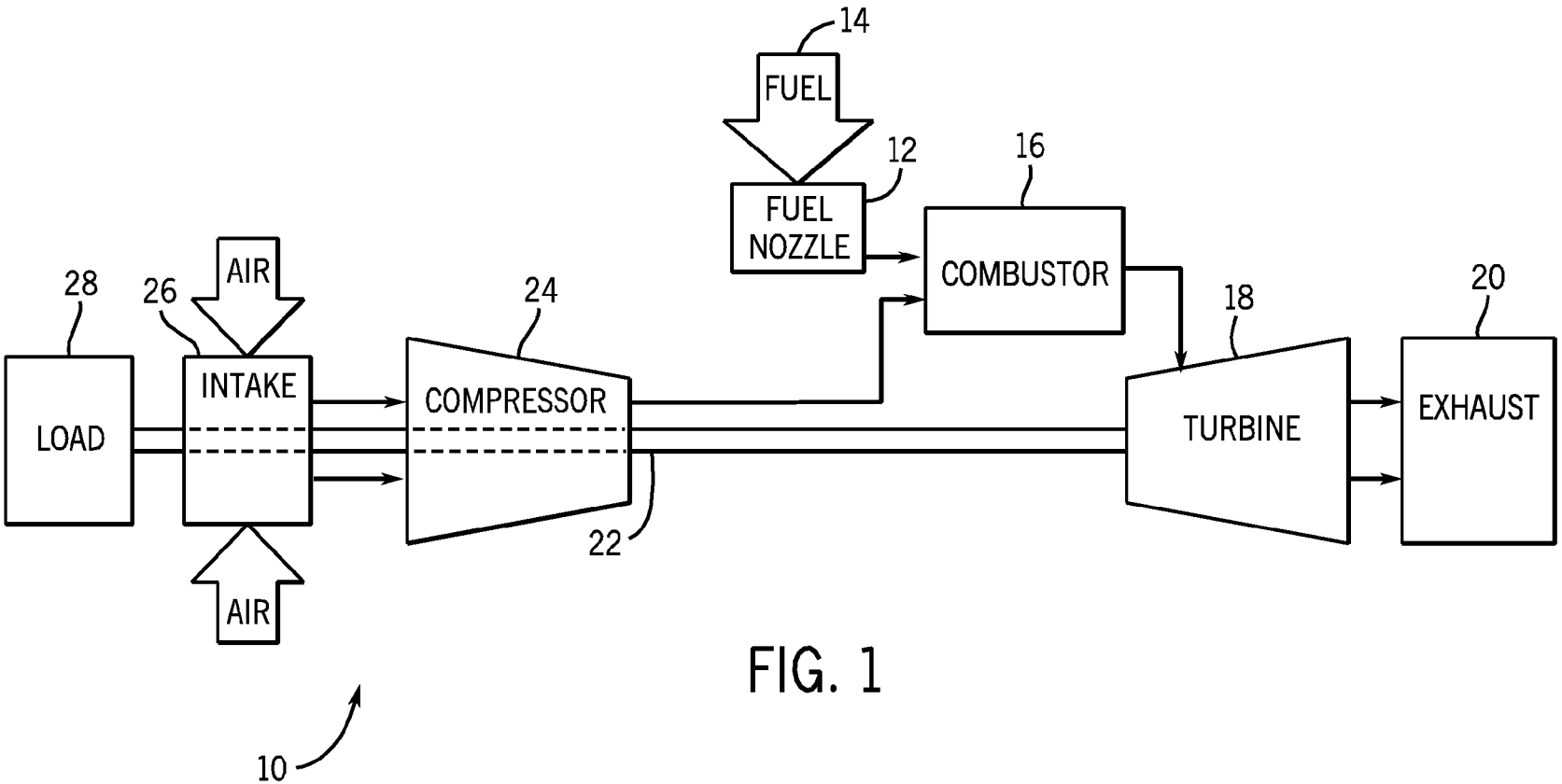
FIG. 1 is a block diagram of an embodiment of a turbine system having a nozzle assembly with feature to reduce amplitudes in combustion dynamics and to improve durability, operability, and reliability.

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

The present disclosure is directed to systems and a method for reducing amplitudes in combustion dynamics in a fuel nozzle assembly as well as improving durability, operability, reliability. Certain combustors include a fuel nozzle assembly with multiple fuel nozzles (i.e., a multi-nozzle assembly). In particular, the multi-nozzle assembly includes multiple fuel nozzles distributed circumferentially about a center fuel nozzle. Fuel enters the fuel nozzles and premixes with air prior to injection from the fuel nozzles. Upon injection from the fuel nozzles, the fuel-air mixture combusts to generate hot combustion products. Combustion dynamics occurring within the combustor may generate large amplitude pressure oscillations (e.g., screech) driven by oscillations in heat release. These larger pressure oscillations may be due to coupling between flames of adjacent fuel nozzles and acoustic waves. Further, these large pressure oscillations may impose operational limits and eventually result in combustor hardware damage.

Embodiments of the present disclosure stagger the heights of the fuel nozzles or axially displace the fuel nozzles relative to one another (i.e., in the direction of flow) to reduce the amplitudes in the combustion dynamics. For example, staggering the heights of the adjacent fuel nozzles with respect to each other decouples flame interaction between the respective flames of the fuel nozzles and, thus, reduces the amplitudes in the pressure oscillations. In certain embodiments, a staggered multi-nozzle assembly includes first and second fuel nozzles each having an axis and a flow path extending to a respective downstream end portion. A cap member is disposed circumferentially about the fuel nozzles to tightly assemble them within the multi-nozzle assembly. The downstream end portions of the fuel nozzles encompass the entire nozzle area of the nozzle assembly, thus, increasing the amount of downstream ends exposed to air passage and the gas turbine output. The downstream ends of the first and second fuel nozzles are axially offset from one another relative to their respective axes. The first fuel nozzle includes a non-circular perimeter (e.g., truncated pie shape) at the downstream end portion. The second fuel nozzle may include a circular or non-circular perimeter (e.g., truncated pie shape). The perimeters of the fuel nozzles may each form a region of a circular nozzle area defined by a perimeter of the cap member. A third fuel nozzle may include another axis and another flow path extending to another downstream end portion. The downstream ends of the first and third fuel nozzles may be axially offset from one another relative to their respective axes. Also, the downstream ends of the first, second, and third fuel nozzles may be axially offset from one another relative to their respective axes. The third fuel nozzle may include a circular or non-circular perimeter (e.g., truncated pie shape). For example, the third fuel nozzle may include a circular perimeter at a central portion within the circular nozzle area, while the first and second fuel nozzles surround the third fuel nozzle with non-circular perimeters (e.g., truncated pie shape).

FIG. 1 is a block diagram of an embodiment of a turbine system 10. As described in detail below, the disclosed turbine system 10 (e.g., a gas turbine engine) may employ a nozzle assembly with multiple fuel nozzles 12 (e.g., a multi-nozzle assembly) configured to reduce amplitudes in combustion dynamics in the nozzle assembly and improve system durability, operability, and reliability. For example, the fuel nozzles 12 may include staggered or axially offset downstream ends to decouple flame interaction between adjacent fuel nozzles 12, thus, reducing amplitudes in combustion dynamics. The turbine system 10 may use liquid or gas fuel, such as natural gas and/or a hydrogen rich synthetic gas, to drive the turbine system 10. As depicted, the fuel nozzles 12 intake a fuel supply 14, mix the fuel with air, and distribute the fuel-air mixture into a combustor 16 in a suitable ratio for optimal combustion, emissions, fuel consumption, and power output. The turbine system 10 may include one or more fuel nozzles 12 located inside one or more combustors 16. The fuel-air mixture combusts in a chamber within the combustor 16, thereby creating hot pressurized exhaust gases. The combustor 16 directs the exhaust gases through a turbine 18 toward an exhaust outlet 20. As the exhaust gases pass through the turbine 18, the gases force turbine blades to rotate a shaft 22 along an axis of the turbine system 10. As illustrated, the shaft 22 may be connected to various components of the turbine system 10, including a compressor 24. The compressor 24 also includes blades coupled to the shaft 22. As the shaft 22 rotates, the blades within the compressor 24 also rotate, thereby compressing air from an air intake 26 through the compressor 24 and into the fuel nozzles 12 and/or combustor 16. The shaft 22 may also be connected to a load 28, which may be a vehicle or a stationary load, such as an electrical generator in a power plant or a propeller on an aircraft, for example. The load 28 may include any suitable device capable of being powered by the rotational output of the turbine system 10.

Figure 2:
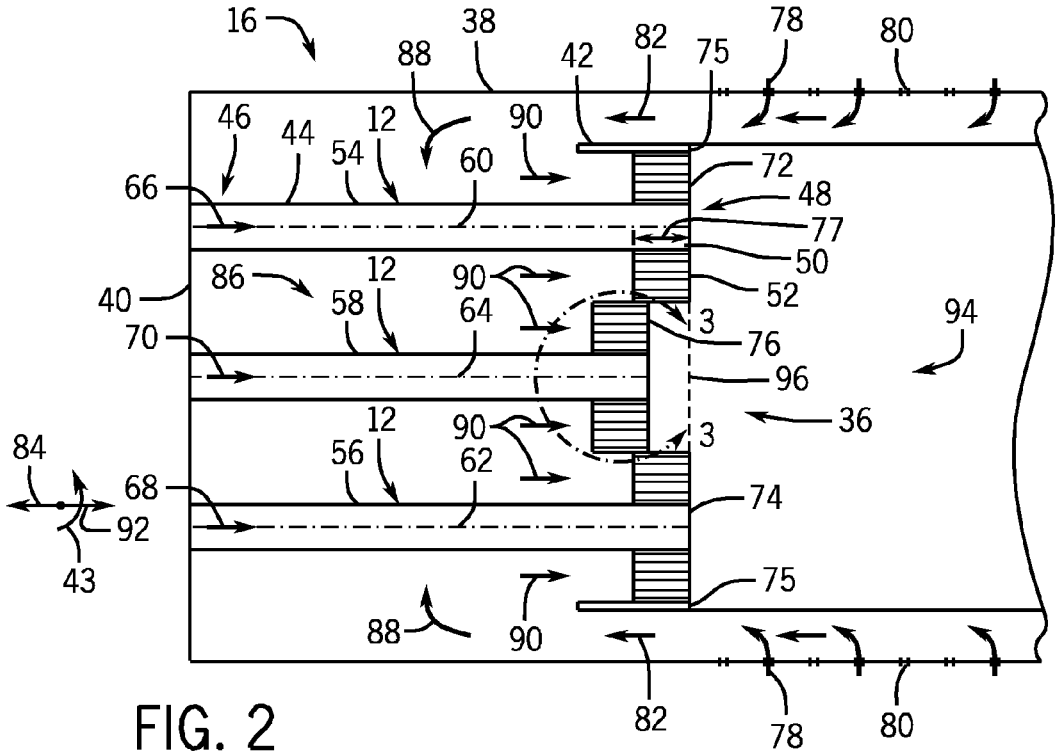
FIG. 2 is a cross-sectional side view of an embodiment of a combustor of FIG. 1 with the nozzle assembly.

FIG. 2 is a cross-sectional side view of an embodiment of the combustor 16 of FIG. 1 with the nozzle assembly 36. The combustor 16 includes an outer casing or flow sleeve 38, the nozzle assembly 36, and an end cover 40. The nozzle assembly 36 is mounted within the combustor 16. The nozzle assembly 36 (i.e., multi-nozzle assembly) includes multiple fuel nozzles 12 assembled within a cap member 42. The cap member 42 is disposed in a circumferential direction 43 about the multiple fuel nozzles 12. Each fuel nozzle 12 includes a fuel conduit 44 extending from an upstream end portion 46 to a downstream end portion 48 of the nozzle 12. In addition, each fuel nozzle 12 includes a fuel chamber 50 coupled to the fuel conduit 44 and multiple premixing tubes 52 extending through the fuel chamber 50 to the downstream end portion 48.

As illustrated, outer fuel nozzles 54 and 56 are disposed within the nozzle assembly 36 adjacent a center fuel nozzle 58. Fuel nozzles 54, 56, and 58 include axes 60, 62, and 64, respectively. In addition, fuel nozzles 54, 56, and 58 include flow paths 66, 68, and 70 (e.g., fuel flow paths), respectively, extending to respective downstream end portions 72, 74, and 76. As illustrated, the center fuel nozzle 58 is recessed with respect to a downstream end portion 75 of the cap member 42. The downstream end portions 72 and 74 of the fuel nozzles 54 and 56 are axially offset from the downstream end portion 76 of the fuel nozzle 58 relative to their respective axes 60, 62, and 64 resulting in an axially staggered multi-nozzle assembly 36. In particular, the downstream end portions 72 and 74 are axially offset downstream from downstream end portion 76. However, as described in detail below, the axial staggering of the downstream end portions 48 of the fuel nozzles 12 may vary in different embodiments. In certain embodiments, an axially offset downstream end portion 48 (e.g., 76) of one fuel nozzle 12 (e.g., 58) may be offset by 1 to 99 percent, 1 to 50 percent, 1 to 25 percent, or 1 to 10 percent a length 77 of the downstream end portion 48 (e.g., 72) of an adjacent fuel nozzle 12 (e.g., 54).

Air (e.g., compressed air) enters the flow sleeve 38, as generally indicated by arrows 78, via one or more air inlets 80 and follows an upstream airflow path 82 in an axial direction 84 towards the end cover 40. Air then flows into an interior flow path 86, as generally indicated by arrows 88, and proceeds along a downstream airflow path 90 in the axial direction 92 through the multiple premixing tubes 52 of each fuel nozzle 12. Fuel flows in the axial direction 92 along the fuel flow paths 66, 68, and 70 through each fuel conduit 44 towards the downstream end portion 48 of each fuel nozzle 12. Fuel then enters the fuel chamber 50 of each fuel nozzle 12 and mixes with air within the multiple premixing tubes 52. The fuel nozzles 12 inject the fuel-air mixture into a combustion region 94 in a suitable ratio for optimal combustion, emissions, fuel consumption, and power output. The staggered configuration of the multi-nozzle assembly 36 discussed above substantially prevents combustion processes (e.g., flames) of the adjacent fuel nozzles from interacting along a plane 96 extending between the downstream end portion 75 of the cap member 42, thus, decoupling the flame interaction. For example, the staggered configuration does not allow flames from fuel nozzles 54 and 56 to interact with the flame from fuel nozzle 58 in order to excite each other. By decoupling the flame interaction, the amplitudes in the large pressure oscillations or combustion dynamics may be reduced.

Figure 3:
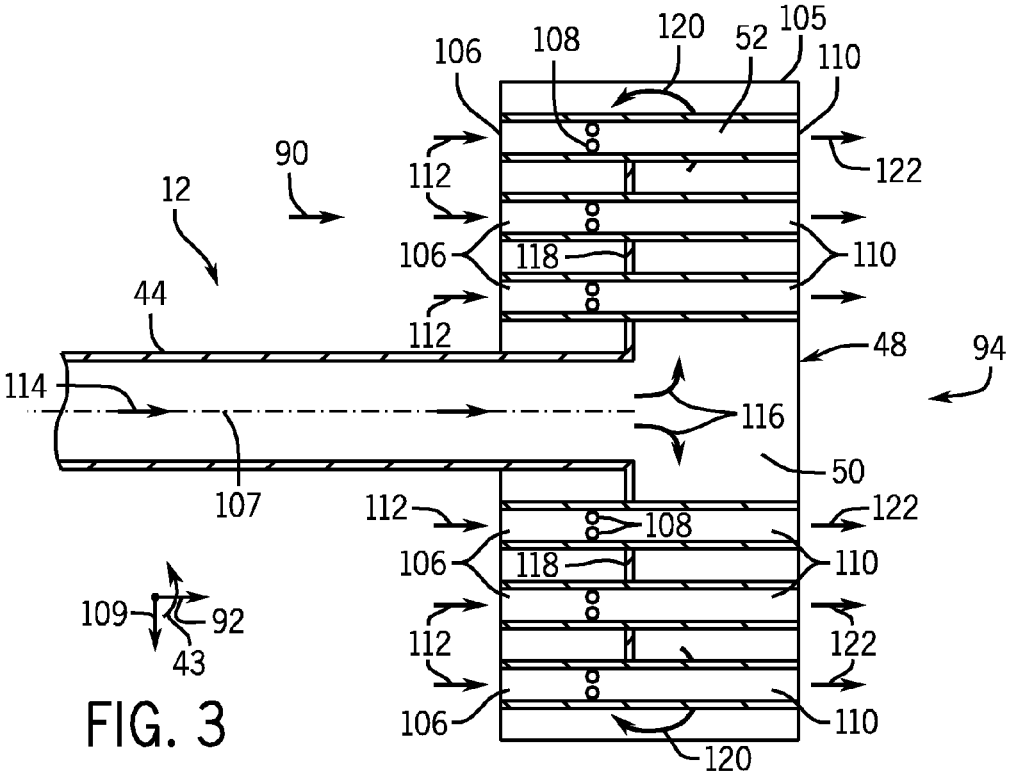
FIG. 3 is a cross-sectional side view of an embodiment of a fuel nozzle of the nozzle assembly, taken within line 3-3 of FIG. 2.

FIG. 3 is a cross-sectional side view of an embodiment of one of the fuel nozzles 12 of the nozzle assembly 36, taken within line 3-3 of FIG. 2. As previously described, the fuel nozzle 12 includes the fuel conduit 44, the fuel chamber 50 coupled to the fuel conduit 44, and the multiple premixing tubes 52 extending through the fuel chamber 50 to the downstream end portion 48. Each tube 52 may represent a row of multiple premixing tubes 52. In certain embodiments, a perimeter 105 of the fuel nozzle 12 may be circular or non-circular (e.g., truncated pie shape). In embodiments where the fuel nozzle 12 includes a circular perimeter 105, the tubes 52 may be arranged in concentric rows about a central axis 107 of the fuel nozzle 12. Further, in certain embodiments, the number of rows, number of tubes 52 per row, and the arrangement of the plurality of tubes 52 may vary. As illustrated, each of the multiple premixing tubes 52 includes air inlets 106, fuel inlets 108 within the fuel chamber 50, and fuel-air outlets 110 at the downstream end portion 48. In certain embodiments, the number of fuel inlets 108 on each tube 52 may range from 0 to 50, 1 to 25, 1 to 10, or any suitable number. Furthermore, the number, size, and position (e.g., axial and circumferential) of the fuel inlets 108 may vary from one tube 52 to another. For example, the numbers and/or size of the fuel inlets 108 (or total cross-sectional area of all fuel inlets 108) per tube 52 may generally increase or decrease in a radial direction 109 from axis 107.

As previously mentioned, air flows along the downstream airflow path 90 in the axial direction 92 and enters the air inlets 106, as generally indicated by arrows 112, of the multiple premixing tubes 52 of the fuel nozzle 12. Fuel flows in the axial direction 92 along fuel flow path 114 through the fuel conduit 44 towards the downstream end portion 48 of the fuel nozzle 12. Fuel then enters the fuel chamber 50 and is diverted towards the plurality of tubes 52, as generally indicated by arrows 116. The fuel nozzle 12 includes a baffle 118 to direct fuel flow within the fuel chamber 50. Fuel flows toward fuel inlets 108, as generally indicated by arrows 120, and mixes with air within the multiple premixing tubes 52. The fuel nozzle 76 outputs the fuel-air mixture from the fuel-air outlets 110 at the downstream end portion 48, as generally indicated by arrows 122, into the combustion region 94.

Figure 4:
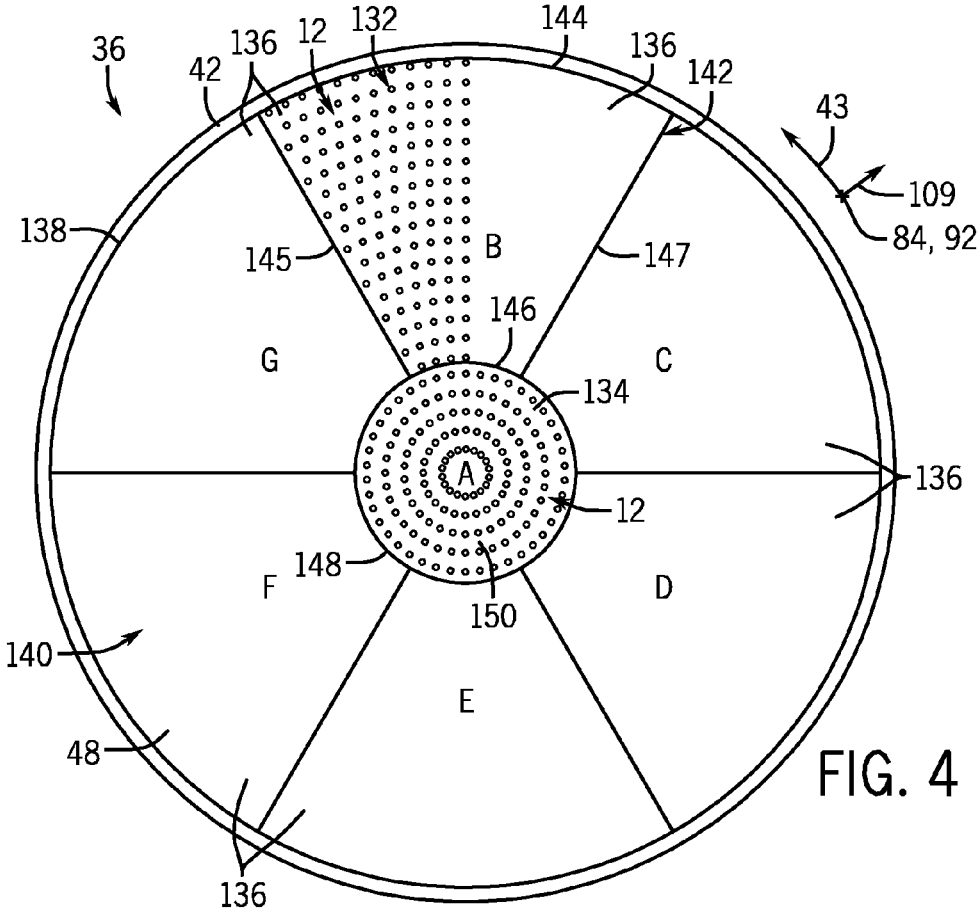
FIG. 4 is a front plan view of an embodiment of the nozzle assembly of FIG. 2.

As previously mentioned, the fuel nozzles 12 of the fuel nozzle assembly 36 may vary in axial staggering or relative placement of the nozzles 12, such that the fuel-air outlets 110 are offset from another between different fuel nozzles 12. FIG. 4 is a front plan view of an embodiment of the nozzle assembly 36 of FIG. 2. The fuel nozzle assembly 36 includes multiple fuel nozzles 12 and cap member 42. Cap member 42 is disposed circumferentially about the fuel nozzles 12 in direction 43 to assemble the fuel nozzle assembly 36. Each fuel nozzle 12 includes multiple premixing tubes 52 arranged in rows 132 as discussed above. The premixing tubes 52 are only shown on portions of some of the fuel nozzles 12 for clarity. As illustrated, the fuel nozzles 12 include a center fuel nozzle 134 (labeled A) and multiple fuel nozzles 12 (outer fuel nozzles 136) disposed circumferentially about the center fuel nozzle 134. As illustrated, six outer fuel nozzles 136 (labeled B, C, D, E, F, and G) surround the center fuel nozzle 134. However, in certain embodiments, the number of fuel nozzles 12 as well as the arrangement of the fuel nozzles 12 may vary. For example, the number of outer fuel nozzles 136 may be 1 to 20, 1 to 10, or any other number. The fuel nozzles 12 are tightly disposed within the cap member 42. As a result, an inner perimeter 138 of the cap member 42 defines a circular nozzle area 140 for the nozzle assembly 36. The downstream end portions 48 of the fuel nozzles 12 encompass the entire circular nozzle area 140. This increases the area 140 of the fuel nozzle assembly 36 exposed to air passage and allows increases in the gas turbine output. Each outer fuel nozzle 136 includes a non-circular perimeter 142. As illustrated, the perimeter 142 includes a truncated pie shape with two parallel sides 144 and 146. The sides 144 and 146 are arcuate shaped, while sides 145 and 147 are linear (e.g., diverging in radial direction 109). However, in certain embodiments, the perimeter 142 of the outer fuel nozzles 136 may include other shapes, e.g., a pie shape with three sides. The perimeter 142 of each outer fuel nozzle 136 includes a region of the circular nozzle area 140. The center fuel nozzle 134 includes a circular perimeter 148. In certain embodiments, the perimeter 148 may include other shapes, e.g., a square, hexagon, triangle, or other polygon. The perimeter 148 of the center fuel nozzle 134 is disposed at a central portion 150 of the circular nozzle area 140. The fuel nozzles 12 are tightly disposed to increase the area 140 of the downstream end portions 48 exposed to air passage.

As mentioned above, the downstream end portions 48 of the fuel nozzles 12 may be staggered or axially offset relative to each other to decouple flame interaction and to reduce amplitudes of combustion dynamics. Also, the downstream end portions 48 may be recessed within the cap member 42 or protrude beyond the cap member 42 in the axial direction 84 and 92. The fuel nozzles 12 may be axially offset individually. For example the downstream end portion 48 of the center fuel nozzle may be recessed or protruded relative to outer fuel nozzles 136 (B, C, D, E, F, and/or G). Alternatively, fuel nozzles 12 may be axially offset as a group relative to each other. For example, the downstream ends 48 of the outer fuel nozzles 136 (B, D, and F) may be recessed or protruded with respect to outer fuel nozzles 136 (C, E, and G) and the center fuel nozzle 134 (A). As a result, the downstream end 48 of the center fuel nozzle 136 may be axially offset with the downstream ends 48 of one or more of the outer fuel nozzles 136 with respect to their respective axes. Also, the downstream ends 48 of the outer fuel nozzles 136 may be axially offset relative to their respective axes. For example, outer fuel nozzle 136 (C) may be recessed or protruded with respect to adjacent outer fuel nozzles 136 (B and D). Further, the fuel nozzles 12 may include varying axial offsets with relative to their respective axes (see FIG. 7). For example, outer fuel nozzles 136 (C and F) may be recessed, but to different degrees, with outer fuel nozzle 136 (C) recessed further within the cap member 42 than outer fuel nozzle 136 (F). Table 1 summarizes various combinations of axial positions for fuel nozzles 12 axially offset (upstream or downstream) relative to the remaining fuel nozzles 12 (i.e., due to protrusions or recessions of the fuel nozzles 12 relative to the cap member 42). However, it should be recognized that Table 1 is not exhaustive and in certain embodiments other combinations of axial positions, including additional axial positions (i.e., a fourth axial position), are possible.

TABLE 1

| First Axial Position | Second Axial Position | Third Axial Position |
|---|---|---|
| A, B, D, and F | C, E, and G | |
| A, C, D, F, and G | B and E | |
| A, B, C, E, and F | D and G | |
| A, B, D, E, and G | C and F | |
| A, B, D, E, and F | C and G | |
| A, B, C, E, and G | D and F | |
| B, C, D, E, F, and G | A | |
| B, D, and F | A, C, E, and G | |
| C, D, F, and G | A, B, and E | |
| B, C, E, and F | A, D, and G | |
| B, D, E, and G | A, C, and F | |
| B, D, E, and F | A, C, and G | |
| B, C, E, and G | A, D, and F | |
| A | C, E, and G | B, D, and F |
| A | B and E | C, D, F, and G |
| A | D and G | B, C, E, and F |
| A | C and F | B, D, E, and G |
| A | C and G | B, D, E, and F |
| A | D and F | B, C, E, and G |
| C, E, and G | B, D, and F | A |
| B and E | C, D, F, and G | A |
| D and G | B, C, E, and F | A |
| C and F | B, D, E, and G | A |
| C and G | B, D, E, and F | A |
| D and F | B, C, E, and G | A |
| B, D, and F | A | C, E, and G |
| C, D, F, and G | A | B and E |
| B, C, E, and F | A | D and G |
| B, D, E, and G | A | C and F |
| B, D, E, and F | A | C and G |
| B, C, E, and G | A | D and F |
| C, E, and G | A | B, D, and F |
| B and E | A | C, D, F, and G |
| D and G | A | B, C, E, and F |
| C and F | A | B, D, E, and G |
| C and G | A | B, D, E, and F |
| D and F | A | B, C, E, and G |
| B, D, and F | C, E, and G | A |
| C, D, F, and G | B and E | A |
| B, C, E, and F | D and G | A |
| B, D, E, and G | C and F | A |
| B, D, E, and F | C and G | A |
| B, C, E, and G | D and F | A |

Figure 5:
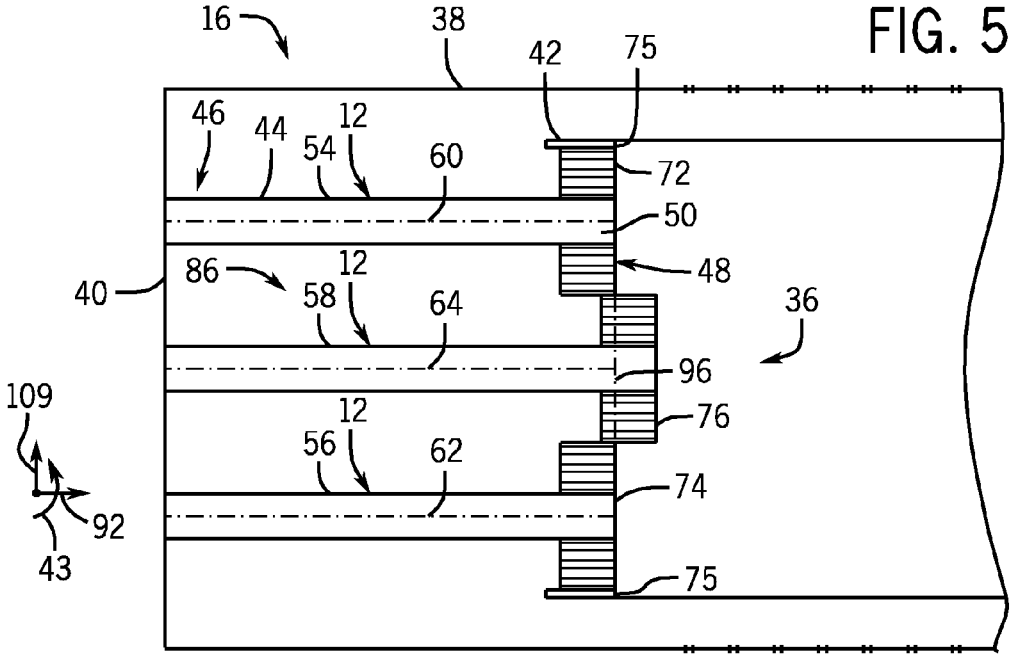
FIG. 5 is a cross-sectional side view of an embodiment of the combustor of FIG. 1 with the nozzle assembly.
Figure 6:
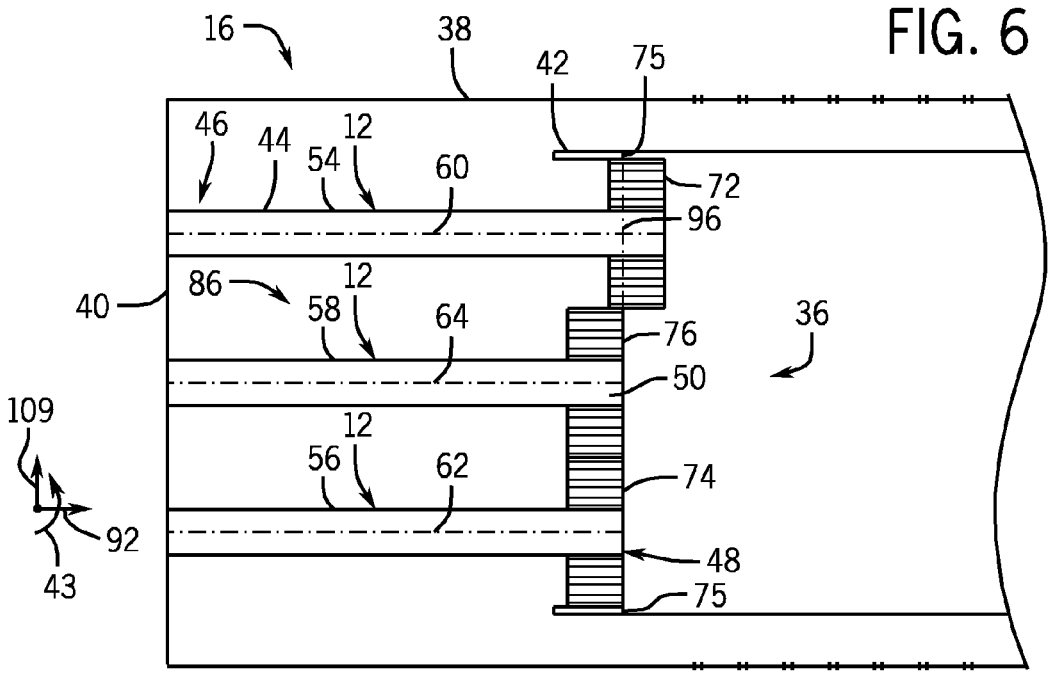
FIG. 6 is a cross-sectional side view of an embodiment of the combustor of FIG. 1 with the nozzle assembly.
Figure 7:
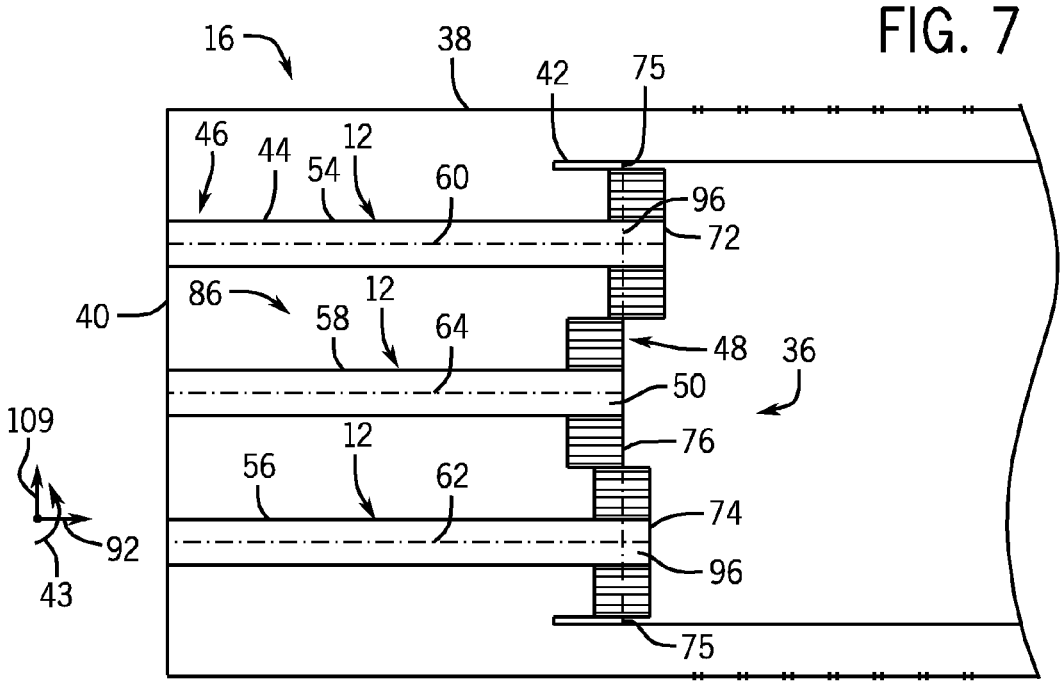
FIG. 7 is a cross-sectional side view of an embodiment of the combustor of FIG. 1 with the nozzle assembly.

FIGS. 5-7 provide further embodiments of staggered or axially offset fuel nozzles 12 within the fuel nozzle assembly 36. FIGS. 5-7 are cross-sectional side views of embodiments of the combustor 16 of FIG. 1 with the nozzle assembly 36. The combustor 16 and fuel nozzle assembly 36 are as described above in FIG. 2. As illustrated in FIG. 5, the outer fuel nozzles 54 and 56 are disposed within the nozzle assembly 36 adjacent the center fuel nozzle 58. The center fuel nozzle 58 protrudes beyond the plane 96 extending between the downstream end portions 75 of the cap member 42. The downstream end portion 76 of the fuel nozzle 58 is axially offset from the downstream end portions 72 and 74 of the fuel nozzles 54 and 56 relative to their respective axes 64, 60, and 62 resulting in the staggered multi-nozzle assembly 36. In particular, the downstream end portion 76 is axially offset downstream from downstream end portions 72 and 74, i.e., in axial direction 92.

As illustrated in FIG. 6, the outer fuel nozzle 54 protrudes beyond the plane 96 extending between downstream end portions 75 of the cap member 42. The downstream end portion 72 of the fuel nozzle 54 is axially offset from the downstream end portions 74 and 76 of the fuel nozzles 56 and 58 relative to their respective axes 60, 62, and 64 resulting in the staggered multi-nozzle assembly 36. In particular, the downstream end portion 72 is axially offset downstream from downstream end portions 74 and 76, i.e., in axial direction 92. Thus, the outer fuel nozzle 54 is staggered or offset with respect to both the center fuel nozzle 58 and the outer fuel nozzle 56.

As illustrated in FIG. 7, the outer fuel nozzle 54 and 56 protrude beyond the plane 96 extending between downstream end portions 75 of the cap member 42. Outer fuel nozzle 54 protrudes further beyond the plane 96 than outer fuel nozzle 56. The downstream end portions 72, 74, and 76 of fuel nozzles 54, 56, and 58 are all axially offset from one another relative to the their respective axes 60, 62, and 64 resulting in the staggered multi-nozzle assembly 36. In particular, the downstream end portion 72 is axially offset downstream from downstream end portions 74 and 76, while the downstream end portion 74 is axially offset downstream from downstream end portion 76. Thus, the fuel nozzles 54, 56, and 58 may be axially offset at different heights or lengths with respect to one another. The embodiments of various staggered configurations of the multi-nozzle assembly 36, as previously discussed, substantially prevent combustion processes (e.g., flames) of the adjacent fuel nozzles 12 from interacting along the same plane 96. In other words, the staggered configuration decouples the flame interaction between the adjacent fuel nozzles 12. By decoupling the flame interaction, the amplitudes in the large pressure oscillations or combustion dynamics may be reduced. Reducing the amplitude in combustion dynamics and increasing the area 140 of the downstream end portions 48 exposed to air passage may increase gas turbine output as well as improve operability, durability, and reliability.

In certain embodiments, a method of operating a turbine system may include routing fuel and air through a first fuel nozzle 12 to a first downstream end portion 48. The first fuel nozzle 12 has a non-circular perimeter at the first downstream end portion 48. In certain embodiments, the non-circular perimeter includes a truncated pie-shaped perimeter. The method also includes routing fuel and air through a second fuel nozzle 12 to a second downstream end portion 48. The second downstream end portion 48 may have a non-circular (e.g., truncated pie shape) or circular perimeter. The first and second downstream end portions 48 are staggered to reduce an amplitude of combustion dynamics (e.g., screech). In certain embodiments, routing fuel and air through the first fuel nozzle 12 includes outputting a fuel-air mixture from the first downstream end portion 48 at an upstream position relative to the second downstream end portion 48. In other embodiments, routing fuel and air through the first fuel nozzle 12 includes outputting the fuel-air mixture from the first downstream end portion 48 at a downstream position relative to the second downstream end portion 48.

Technical effects of the disclosed embodiments include systems and methods to reduce amplitudes in combustion dynamics. The embodiments disclosed herein reduce the amplitudes in combustion dynamics by staggering or axially offsetting downstream end portions 48 of adjacent fuel nozzles 12 within the nozzle assembly 36, e.g., in a combustion system such as a gas turbine engine. Staggering the downstream end portions 48 of adjacent fuel nozzles decouples flame interaction between the nozzles. In addition, increasing the nozzle area 140 of the nozzle assembly allows more air passage. Together, the reduction in amplitudes of combustion dynamics and increase in nozzle area 140 may improve turbine system operability, durability, and reliability.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A system, comprising:

a staggered multi-nozzle assembly, comprising:

a first fuel nozzle having a first axis and a first flow path extending to a first downstream end portion, wherein the first fuel nozzle has a first non-circular perimeter at the first downstream end portion, wherein the first fuel nozzle comprises a first fuel conduit, a first fuel chamber coupled to the first fuel conduit, a first plurality of premixing tubes extending through the first fuel chamber, and each of the first plurality of premixing tubes includes a first air inlet, a first fuel inlet, and a first fuel-air outlet at the first downstream end portion;

a second fuel nozzle having a second axis and a second flow path extending to a second downstream end portion, wherein the first and second downstream end portions are staggered from one another relative to the first and second axes in an axial direction; and a cap member disposed circumferentially about at least the first and second fuel nozzles to assemble the staggered multi-nozzle assembly.

2. The system of claim 1, wherein the first non-circular perimeter comprises a first region of a circular nozzle area defined by a perimeter of the cap member.

3. The system of claim 2, wherein the second fuel nozzle comprises a second non-circular perimeter, and the second non-circular perimeter comprises a second region of the circular nozzle area.

4. The system of claim 3, comprising a third fuel nozzle having a third axis and a third flow path extending to a third downstream end portion, wherein the first and third downstream end portions are staggered from one another relative to the first and third axes in the axial direction, and the third fuel nozzle comprises a circular perimeter at a central portion within the circular nozzle area.

5. The system of claim 4, wherein the first, second, and third downstream end portions are staggered from one another relative to the first, second, and third axes in the axial direction.

6. The system of claim 1, wherein the second fuel nozzle comprises a circular perimeter.

7. The system of claim 1, wherein the second fuel nozzle comprises a second fuel conduit, a second fuel chamber coupled to the second fuel conduit, a second plurality of premixing tubes extending through the second fuel chamber, and each of the second plurality of premixing tubes includes a second air inlet, a second fuel inlet, and a second fuel-air outlet at the second downstream end portion.

8. The system of claim 1, comprising a turbine combustor having the staggered multi-nozzle assembly.

9. The system of claim 8, comprising a gas turbine engine having the turbine combustor with the staggered multi-nozzle assembly.

10. The system of claim 1, wherein the first and second downstream end portions are separate from each other.

11. The system of claim 1, wherein the first and second downstream end portions each include a constant cross-sectional area in the axial direction.

12. A system, comprising:

a turbine nozzle assembly, comprising:

a first fuel nozzle having a first axis and a first plurality of premixing tubes extending to a first downstream end portion, wherein the first fuel nozzle has a first truncated pie-shaped perimeter at the first downstream end portion, wherein the first truncated pie-shaped perimeter is defined by a first side and a second side that are parallel with each other, and a first linear side and a second linear side that diverge with respect to each other in a radial direction; and a second fuel nozzle having a second axis and a second plurality of premixing tubes extending to a second downstream end portion, wherein the first and second downstream end portions are staggered from one another relative to the first and second axes in an axial direction, and the first and second downstream end portions are separate from each other.

13. The system of claim 12, wherein the second fuel nozzle comprises a circular perimeter.

14. The system of claim 13, wherein the first downstream end portion is staggered downstream from the second downstream end portion in the axial direction.

15. The system of claim 13, wherein the second downstream end portion is staggered downstream from the first downstream end portion in the axial direction.

16. The system of claim 12, wherein the second fuel nozzle comprises a second truncated pie-shaped perimeter defined by a third side and a fourth side that are parallel with each other, and a third linear side and a fourth linear side that diverge with respect to each other in the radial direction.

17. The system of claim 12, comprising a third fuel nozzle having a third axis and a third plurality of premixing tubes extending to a third downstream end portion, wherein the first and third downstream end portions are staggered from one another relative to the first and third axes in the axial direction.

18. The system of claim 17, wherein the first, second, and third downstream end portions are staggered from one another relative to the first, second, and third axes in the axial direction.

19. The system of claim 12, wherein the first and second downstream end portions each include a constant cross-sectional area in the axial direction.

20. The system of claim 12, wherein the first side comprises a first arcuate shaped side and the second side comprises a second arcuate shaped side.

21. A method, comprising:

routing fuel and air through a first fuel nozzle of a turbine nozzle assembly to a first downstream end portion, wherein the first fuel nozzle has a first non-circular perimeter at the first downstream end portion, wherein the first fuel nozzle comprises a first fuel conduit, a first fuel chamber coupled to the first fuel conduit, a first plurality of premixing tubes extending through the first fuel chamber, and each of the first plurality of premixing tubes includes a first air inlet, a first fuel inlet, and a first fuel-air outlet at the first downstream end portion; and routing fuel and air through a second fuel nozzle of the turbine nozzle assembly to a second downstream end portion, wherein the first and second downstream end portions are staggered in an axial direction to reduce amplitude of combustion dynamics, and a cap member disposed circumferentially about at least the first and second fuel nozzles to assemble the turbine nozzle assembly.

22. The method of claim 21, wherein routing fuel and air through the first fuel nozzle comprises outputting a first fuel-air mixture from the first downstream end portion at an upstream position relative to the second downstream end portion, wherein the first non-circular perimeter comprises a first truncated pie-shaped perimeter defined by a first side and a second side that are parallel with each other, and a first linear side and a second linear side that diverge with respect to each other in a radial direction.

23. The method of claim 21, wherein routing fuel and air through the first fuel nozzle comprises outputting a first fuel-air mixture from the first downstream end portion at a downstream position relative to the second downstream end portion, wherein the first non-circular perimeter comprises a first truncated pie-shaped perimeter defined by a first side and a second side that are parallel with each other, and a first linear side and a second linear side that diverge with respect to each other in a radial direction.

* * * * *